United States Patent [19]

Petrelewicz et al.

[11] 4,221,451

[45] Sep. 9, 1980

[54] ELECTRICAL TEST ADAPTER PLUG

[75] Inventors: Edward F. Petrelewicz, La Grange; Josef Keglewitsch, Addison, both of Ill.

[73] Assignee: Bunker Ramo Corporation, Oak Brook, Ill.

[21] Appl. No.: 841,273

[22] Filed: Oct. 12, 1977

[51] Int. Cl.[2] ..... H01R 13/58

[52] U.S. Cl. ..... 339/105; 179/1 PC; 339/176 MP; 339/205

[58] Field of Search ..... 339/105, 103 R, 176 M, 339/176 R, 176 MP, 108 TP, 147 P, 205; 179/175, 1 PC

[56] References Cited

U.S. PATENT DOCUMENTS

| | | | |
|---|---|---|---|
| 1,953,966 | 4/1934 | Lynch | 359/191 R |
| 1,960,191 | 5/1934 | Staub et al. | 339/191 R |
| 2,249,153 | 7/1941 | Martin | 339/108 TP |
| 2,703,395 | 3/1955 | Long | 339/205 |
| 2,726,374 | 12/1955 | Lipton | 339/105 |
| 2,732,534 | 1/1956 | Giel | 339/191 R |
| 2,732,534 | 1/1956 | Giel | 339/191 R |
| 3,086,190 | 4/1963 | Neidecker et al. | 339/205 |
| 3,325,770 | 6/1967 | Hammell et al. | 339/176 M |
| 3,617,985 | 11/1971 | Kehl | 179/1 PC |
| 3,818,422 | 6/1974 | Pertuit | 339/205 X |
| 3,922,507 | 11/1975 | White | 179/175 |
| 4,002,861 | 1/1977 | Putt | 179/175 |

*Primary Examiner*—Roy Lake
*Assistant Examiner*—DeWalden W. Jones
*Attorney, Agent, or Firm*—F. M. Arbuckle; B. W. Sufrin; N. A. Camasto

[57] ABSTRACT

A test adapter plug for connecting a solid wire conductor to a wire-wrap terminal post includes an elongated insulating housing having first and second openings respectively dimensioned to conform to the terminal post and the solid wire conductor, with the conductor opening accommodating passage therethrough only of the bare wire and not the insulation thereon. The housing contains two spaced-apart electrical receptacles interconnected by a conductor or a circuit element, such as a diode, each receptacle having a pair of spaced-apart spring contacts with the pairs of contacts respectively disposed adjacent to the two openings in alignment therewith for receiving and electrically contacting the terminal post and the solid wire conductor. The housing carries a strain relief member adjacent to the conductor opening for receiving the insulated portion of the conductor.

3 Claims, 5 Drawing Figures

ELECTRICAL TEST ADAPTER PLUG

BACKGROUND OF THE INVENTION

The invention is directed generally to electrical connectors and, more particularly, to a connector for providing a plug-type interconnection between a solid wire conductor and a wire-wrap terminal post, such as on a panelboard.

In the data and communication industries there is extensive use of terminal boards which have a plurality of terminal posts extending therefrom for connecting the associated circuitry with other equipment. Particularly in the area of telephony, large numbers of such terminal boards are utilized in telephone central offices. It is frequently necessary to make temporary connections of wire conductors to selected ones of the terminal posts for performing test operations and the like.

At present, temporary connections of individual wire conductors to a terminal post are made by simply wrapping the stripped end of the wire conductor around the terminal post, which post is normally rectangular or square in transverse cross section to facilitate engagement between the post and the conductor. But this operation is extremely time-consuming and labor-intensive. Furthermore, the winding of the wire conductor around the terminal post seriously weakens the conductor and, therefore, the conductor must continually be cut back and restripped on succeeding operations, resulting in considerable waste.

Adapter plugs, such as those disclosed in U.S. Pat. No. 3,325,770, issued to K. M. Hammell et al. on June 13, 1967, have been provided, but such plugs require the permanent mounting on the wire conductor of a special type of terminal contact for mating with the plug receptacle.

SUMMARY OF THE INVENTION

Accordingly, the invention is directed to an electrical connector for providing a temporary electrical connection between a wire-wrap terminal post and a bare terminal portion of an insulated solid wire conductor.

More particularly, an important feature of this invention is the provision of an electrical connector which permits a quick and simple push-in or plug-type connection of the solid wire conductor directly to the connector without any modification of the conductor and without the use of any special tools.

Another feature of this invention is the provision of an electrical connector of the type set forth which inhibits accidental disconnection of the solid wire conductor from the connector.

Still another feature of this invention is that the electrical connector permits 15 to 20 reuses of a single wire conductor without appreciable weakening thereof or damage thereto.

The connector comprises an insulating housing having first and second openings, the first opening having a portion conforming to the associated terminal post for receiving the post therethrough to mount the housing on the post, and the second opening having a portion conforming to the bare terminal portion of the associated solid wire conductor for receiving therethrough the bare terminal portion of the conductor while preventing passage therethrough of the insulated portion of the conductor. A first electrical receptacle is disposed within the housing adjacent to the first opening for receiving in electrical contact therewith an associated terminal post received through the first opening. A second electrical receptacle is disposed within the housing adjacent to the second opening for receiving in electrical contact therewith the bare terminal portion of an associated solid wire conductor received through the second opening. Connecting means disposed within the housing provides an electrical connection between the first and second electrical receptacles.

BRIEF DESCRIPTION OF THE DRAWINGS

The features of the present invention which are believed to be novel are set forth with particularity in the appended claims. The invention, together with further objects and advantages thereof, may best be understood by reference to the following description taken in connection with the accompanying drawings, in which:

DESCRIPTION OF THE PREFERRED EMBODIMENT

Figures 1, 2, 3, 4, 5:
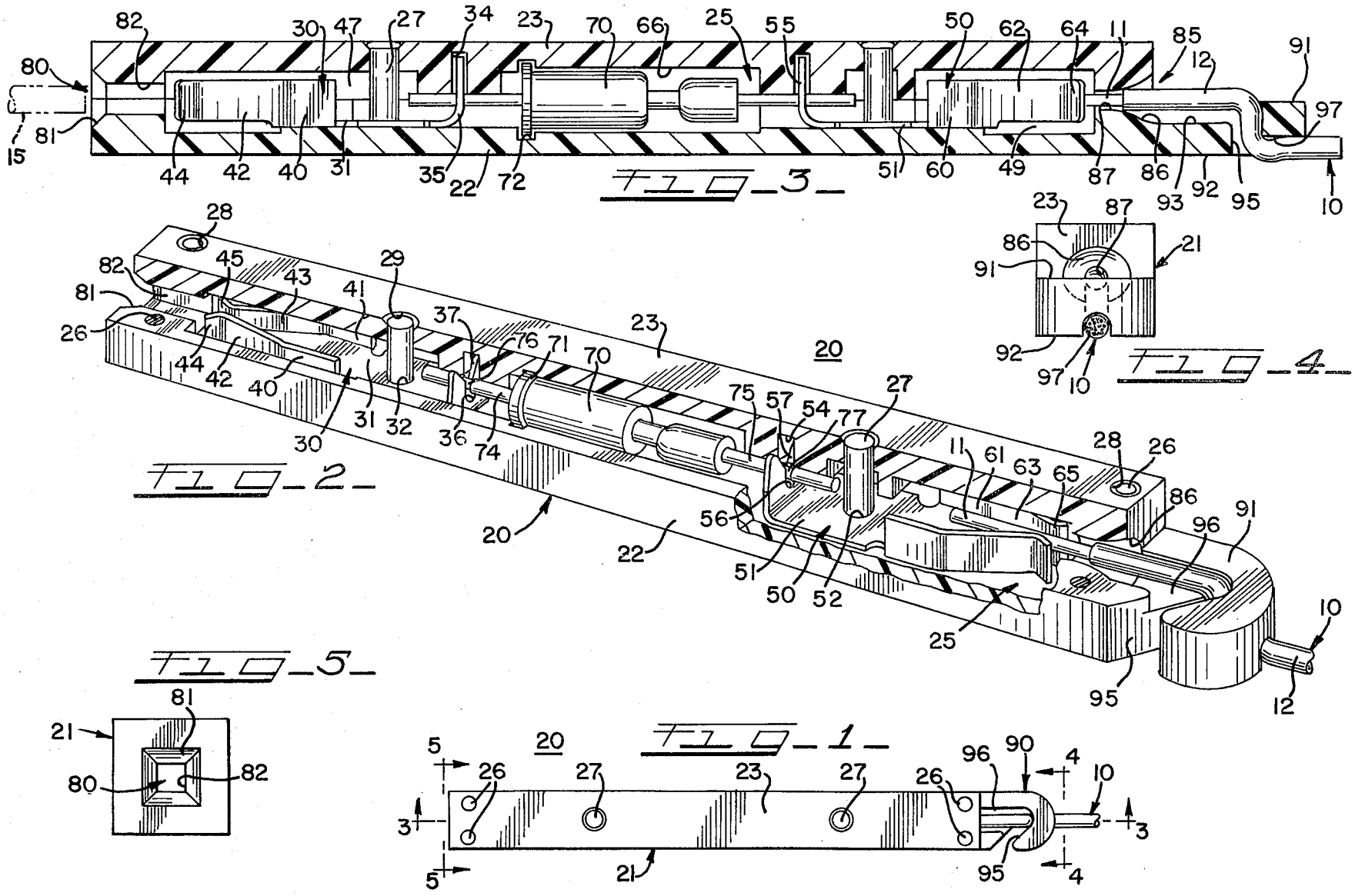
FIG. 1 is a top plan view of an electrical connector constructed in accordance with and embodying the features of the present invention, and illustrated with a solid wire conductor connected thereto.
FIG. 2 is an enlarged perspective view of the electrical connector of FIG. 1, with portions of the housing broken away more clearly to show the internal construction of the connector.
FIG. 3 is an enlarged view in vertical section taken along the line 3—3 in FIG. 1.
FIG. 4 is an enlarged end elevational view of the connector of the present invention, taken along the line 4—4 in FIG. 1.
FIG. 5 is an enlarged end elevational view of the connector of the present invention, taken along the line 5—5 in FIG. 1.

There is illustrated in the drawings an electrical connector in the form of a test adapter plug, generally designated by the numeral 20, which is designed to have one end thereof connectable to an insulated wire, generally designated by the numeral 10, which includes a solid wire conductor 11 surrounded with insulation 12, the other end of the connector 20 being adapted for connection to a panelboard wire-wrap terminal post, indicated in broken line at 15 in FIG. 3, and which is preferably of square or rectangular cross section. The connector 20 includes a two-part housing, generally designated by the numeral 21, which includes an elongated base 22 and an elongated cover 23, each of which is preferably integrally formed of a thermoplastic insulating material. The base 22 and cover 23 are adapted for mating engagement with each other to form a housing which is square or rectangular in transverse cross section. The base 22 is provided with a plurality of upstanding small diameter posts 26 and large diameter posts 27 respectively adapted to be received in complementary openings 28 and 29 in the cover 23 for holding the parts together in assembled condition. Each of the base 22 and cover 23 is provided with an irregularly recessed inner surface so that when they are joined together they cooperate to define an irregular central cavity 25 extending longitudinally through the housing 21 and comprising a plurality of intercommunicating chambers.

Disposed in a chamber 47 adjacent to one end of the cavity 25 is an electrical receptacle, generally designated by the numeral 30 and integrally formed of a good electrically conducting material such as a copper alloy.

The receptacle 30 includes a flat base plate 31 which rests upon the housing base 22 and is provided with a circular aperture 32 for receiving therethrough one of the posts 27 for securing the parts of the connector together in a manner which will be described more fully below. Extending vertically upwardly from the base plate 31 into a chamber 34 of the cavity 25 is a contact flange 35 (FIG. 3) having a vertical notch 36 extending downwardly thereinto, the notch 36 having a flared entry portion 37. Extending upwardly from the opposite sides of the base plate 31 at the outer end thereof are two flanges 40 and 41 which are formed integral with base plate 31 and which include longitudinally converging spring fingers 42 and 43 which are provided with respective outwardly flared contact tips 44 and 45.

Similarly, there is provided in a chamber 49 adjacent to the other end of the cavity 25 an electrical receptacle, generally designated by the numeral 50, which is preferably substantially identical in construction to the electrical receptacle 30. More particularly, the receptacle 50 includes a flat base plate 51 which rests upon the housing base 22 and is provided with a circular aperture 52 for receiving one of the posts 27 therethrough for securing the parts of the connector together. Extending vertically upwardly from the base plate 51 into a chamber 54 of the cavity 25 is a contact flange 55 having a vertical notch 56 extending downwardly therein, the notch 56 having a flared entry portion 57. Extending upwardly from the opposite sides of the base plate 51 at the outer end thereof are two flanges 60 and 61 which are formed integral with base plate 51 and which include longitudinally converging spring fingers 62 and 63 which are provided with respective outwardly flared contact tips 54 and 55.

In the illustrated embodiment a diode 70 is disposed in a central chamber 66 of the cavity 25; the diode 70 having a circumferential flange 71 extending outwardly therefrom at one end thereof and which may be received in a complementary annular recess 72 formed in the housing 21. The diode 70 is provided with coaxial terminal leads, 74 and 75 respectively, extending from the opposite ends thereof, and each having a diameter slightly greater than the width of the notches 36 and 56 in the receptacle flanges 35 and 55. The terminal leads 74 and 75 are, therefore, press fitted into the notches 36 and 56 for fixedly securing the diode 70 to the receptacles 30 and 50 in electrical contact therewith, the press fitting operation deforming the leads 74 and 75 as at 76 and 77.

Providing communication between the exterior of the housing 21 and the cavity 25 at one end thereof is an axially extending rectangular terminal post opening, generally designated by the numeral 80, which includes a flared entry portion 81 and a restricted portion 82 which conforms to an associated terminal post 15 for receiving the terminal post 15 therethrough, and directing the exposed post through the flared contact tips 44 and 45.

In like manner, the housing 21 is provided at the other end thereof with a conductor opening 85 which communicates with the cavity 25 and includes a flared entry portion 86 and a restricted circular portion 87 which conforms generally to the bare solid wire conductor 11 for receiving it therethrough. The restricted portion 87 of the opening 85 does not permit passage therethrough of the insulator 12 surrounding the solid wire conductor 11.

Integral with the base 22 and extending axially therefrom adjacent to the conductor opening 85 is a projection 90 having an upper surface 91 which substantially bisects the conductor opening 85 and a lower surface 92 which is parallel to the upper surface 91 and substantially coplanar with the bottom of the housing base 22. Extending laterally into the projection 90 from one side thereof is a slot 95 which extends vertically between the top and bottom surfaces 91 and 92 substantially normal thereto and extends horizontally to the longitudinal axis of the housing 21. Formed in the top surface 91 and extending longitudinally of the housing 21 from the conductor opening 85 to the upper end of the slot 95 is a recess 96 which has a depth approximately equal to the maximum radius of the opening 85. Formed in the bottom surface 92 extending longitudinally of the housing 21 from the bottom of the slot 95 to the distal end of the projection 90 is an arcuate recess 97 shaped and dimensioned to accommodate the insulated wire 10 therein. The slot 95 has a width slightly greater than the outer diameter of the insulated wire 10, the notch 95 cooperating with the recesses 96 and 97 to define a generally Z-shaped strain relief path for the insulated wire 10 through the projection 90.

In assembly of the connector 20, the receptacles 30 and 50 are respectively seated in the corresponding portions of the chambers 47 and 49 in the base 22, with the large diameter posts 27 being respectively received through the openings 32 and 52 for positioning the receptacles 30 and 50. Next, the diode 70 is inserted into the chamber 66, the leads 74 and 75 being respectively press fitted in the notches 36 and 56 of the contact flanges 35 and 55. Finally, the cover 23 is snapped in place over the posts 26 and 27.

In operation, the connector 20 is mounted on an associated terminal post 15 with the post 15 received in the opening 80 and extending therethrough and projecting between the contact tips 44 and 45 of the receptacle 30. In this regard, it will be noted that the normal distance between the contact tips 44 and 45 is substantially less than the width of the terminal post 15 so that the post 15 is resiliently gripped between the contact tips 44 and 45 in electrical contact therewith in a well-known manner. With the connector 20 thus mounted on the terminal post 15, the stripped terminal end of the solid wire conductor 11 is inserted into the opening 85 until the insulation 12 thereof seats against the flared entry portion 86 of the opening 85. The solid wire conductor 11 extends through the opening 85 and into the contact tips 64 and 65 of the receptacle 50, thereby effecting electrical contact therewith. An electrically conductive path is thereby established between the terminal post 15 and the solid wire conductor 11. The insulated portion of the wire 10 is then inserted into the slot 95 and pulled snugly up into the bottom recess 97. The resulting double bend in the wire 10, engaging the corners of the Z-shaped strain relief member, helps to prevent slippage of the wire 10 through the path as a result of tension forces applied to the wire 10. Thus, there is achieved an effective strain relief mounting of the wire 10 to inhibit accidental disengagement of the solid wire conductor 11 from the receptacle 50. When it is desired to disconnect the wire 10 from the connector 20, the wire 10 is simply grasped adjacent to the projection 90 and is swung in a generally clockwise motion downwardly out of the recess 97 and then out of the slot 95, after which the wire 10 can be pulled straight out of the opening 85. Since there is no wrapping of the stripped terminal portion of the solid wire conductor 11, it has been found that the wire 10 can be reused approximately fifteen to twenty times without breakage thereof.

Preferably, the receptacles 30 and 50 are identically constructed, the only difference being that the initial gap between the contact tips 64 and 65 typically is less than that between the contact tips 44 and 45 depending on the size of the wire to be connected thereto.

While the invention has been disclosed with the receptacles 30 and 50 interconnected by a diode, it will be appreciated that other types of suitable circuit elements, including test components such as resistors, capacitors or the like, or combinations thereof, could be utilized in place of the diode 70, depending upon the particular testing function to be performed. A direct wire connection may be provided between the receptacles 30 and 50, as well.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. An electrical connector for providing a temporary plug-in electrical connection between independent conductive members including a panelboard terminal post and a bare terminal portion of an insulated wire conductor, said connector comprising:

an insulating housing having first and second openings thereinto;

said first opening having a portion conforming to the associated terminal post for receiving the post therethrough to mount said housing on the post;

said second opening having a portion conforming to the bare terminal portion of the associated wire conductor for receiving therethrough the bare terminal portion of the conductor;

first and second electrical receptacles disposed within said housing;

said first and second receptables each having means for independently gripping and establishing electrical contact with said independent conductive members upon introduction of one of the conductive members into a respective one of said first second openings;

said first electrical receptacle being disposed adjacent to said first opening for receiving therein in electrical contact therewith said terminal post received through said first opening and gripping said terminal post independently of said other receptacle;

said second electrical receptacle being disposed adjacent to said second opening and having means for readily receiving therein in electrical contact therewith the bare terminal portion of an associated wire conductor received through said second opening and gripping said bare terminal portion independently of said gripping of said terminal post by said first electrical receptacle and maintaining the terminal portion in a linear configuration without deforming the bare terminal portion to provide for ready insertion and removal thereof; and test component means disposed within said housing and interconnecting said first and second electrical receptacles for performing test operations between the panelboard terminal post gripped by said first receptacle and the bare terminal portion of said conductor gripped by said second receptacle, said test component means being removably mounted in said housing to permit interchangable interconnection of different test component means between said first and second electrical receptacles.

2. An electrical connector for providing a temporary plug-in electrical connection between a panelboard terminal post and a bare terminal portion of an insulated wire conductor, said connector comprising:

a generally rigid insulating housing having first and second openings;

said first opening having a portion for receiving the post therethrough to mount said housing on the post;

said second opening having a portion for receiving therethrough the bare terminal portion of the conductor;

an electrical receptacle means disposed within said housing for releasably engaging said terminal post and the bare terminal portion of said wire conductor;

a strain relief member formed integral with said housing and extending outwardly therefrom adjacent to said second opening and defining a generally Z-shaped path for the insulated portion of said wire conductor, whereby tension forces applied to the insulated portion of the solid wire conductor outboard of said strain relief member are absorbed by said strain relief member and not transmitted to the bare terminal portion of the conductor, said strain relief member having an upper surface lying in a plane substantially bisecting said second opening and a lower surface substantially parallel to said upper surface, an elongated recess in said upper surface disposed substantially coaxially with said second opening and communicating therewith, a recess formed in said lower surface generally in longitudinal alignment with said upper recess and a notch extending vertically between said upper and lower surfaces and extending horizontally from the perimeter of said strain relief member to the axes of said first and second recesses for interconnecting the same and cooperating therewith to define said Z-shaped path.

3. An electrical connector for providing a temporary plug-in electrical connection between a panelboard terminal post and a bare terminal portion of an insulated wire conductor, said connector comprising:

a generally rigid insulating housing having first and second openings;

said first opening having a portion for receiving the post therethrough to mount said housing on the post;

said second opening having a portion for receiving therethrough the bare terminal portion of the conductor;

an electrical receptacle means disposed within said housing for releasably engaging said terminal post and the bare terminal portion of said wire conductor;

a strain relief member integral with said housing and extending outwardly therefrom adjacent to said second opening and defining a generally Z-shaped path for the insulated portion of said wire conductor, whereby tension forces applied to the insulated portion of the solid wire conductor outboard of said strain relief member are absorbed by said strain relief member and not transmitted to the bare terminal portion of the conductor; p1 said strain relief member having an upper surface lying in a plane substantially bisecting said second opening and a lower surface substantially parallel to said upper surface, an elongated recess in said upper surface disposed substantially coaxially with said second opening and communicating therewith, and a notch extending between said upper and lower surfaces from the perimeter of said strain relief member to the axis of said second opening for interconnecting said upper and lower surfaces and cooperating therewith to define said Z-shaped path.

* * * * *